United States Patent [19]

Kanik

[11] 4,076,062

[45] Feb. 28, 1978

[54] POWER DRIVEN LOG SPLITTER

[75] Inventor: Robert W. Kanik, Alder Creek, N.Y.

[73] Assignee: R. Kanik Sales, Ltd., Black River, N.Y.

[21] Appl. No.: 681,475

[22] Filed: Apr. 29, 1976

[51] Int. Cl.[2] ..... B27L 7/00

[52] U.S. Cl. ..... 144/193 A; 144/3 N

[58] Field of Search ..... 254/104; 144/193 R, 144/193 A, 193 D, 119 E, 3 N

[56] References Cited

U.S. PATENT DOCUMENTS

| | | | |
|---|---|---|---|
| 885,458 | 4/1908 | Eckenroth, Jr. | 144/193 A |
| 1,020,072 | 3/1912 | Barnhart | 144/193 A |
| 3,077,214 | 2/1963 | Brukner | 144/193 A |
| 3,242,955 | 3/1966 | Hellstrom | 144/193 A |
| 3,640,323 | 2/1972 | Helle | 144/193 A |

*Primary Examiner*—Travis S. McGehee
*Assistant Examiner*—W. D. Bray
*Attorney, Agent, or Firm*—Charles S. McGuire

[57] ABSTRACT

Apparatus for splitting logs by pushing the logs endwise against a stationary splitting wedge. A gasoline motor drives a pump which powers a hydraulic ram in conventional fashion. The frame means upon which the wedge is mounted comprise two U-shaped channel members fixedly secured with the legs of the Us extending toward one another and the free edges in spaced, parallel relation on the top and bottom, whereby a log may be supported upon the upper free edges while being advanced against the wedge. The log-engaging member of the ram is also supported and guided by the channel members. Automatic throttle advance and hydraulic valve control mechanisms are also provided.

6 Claims, 6 Drawing Figures

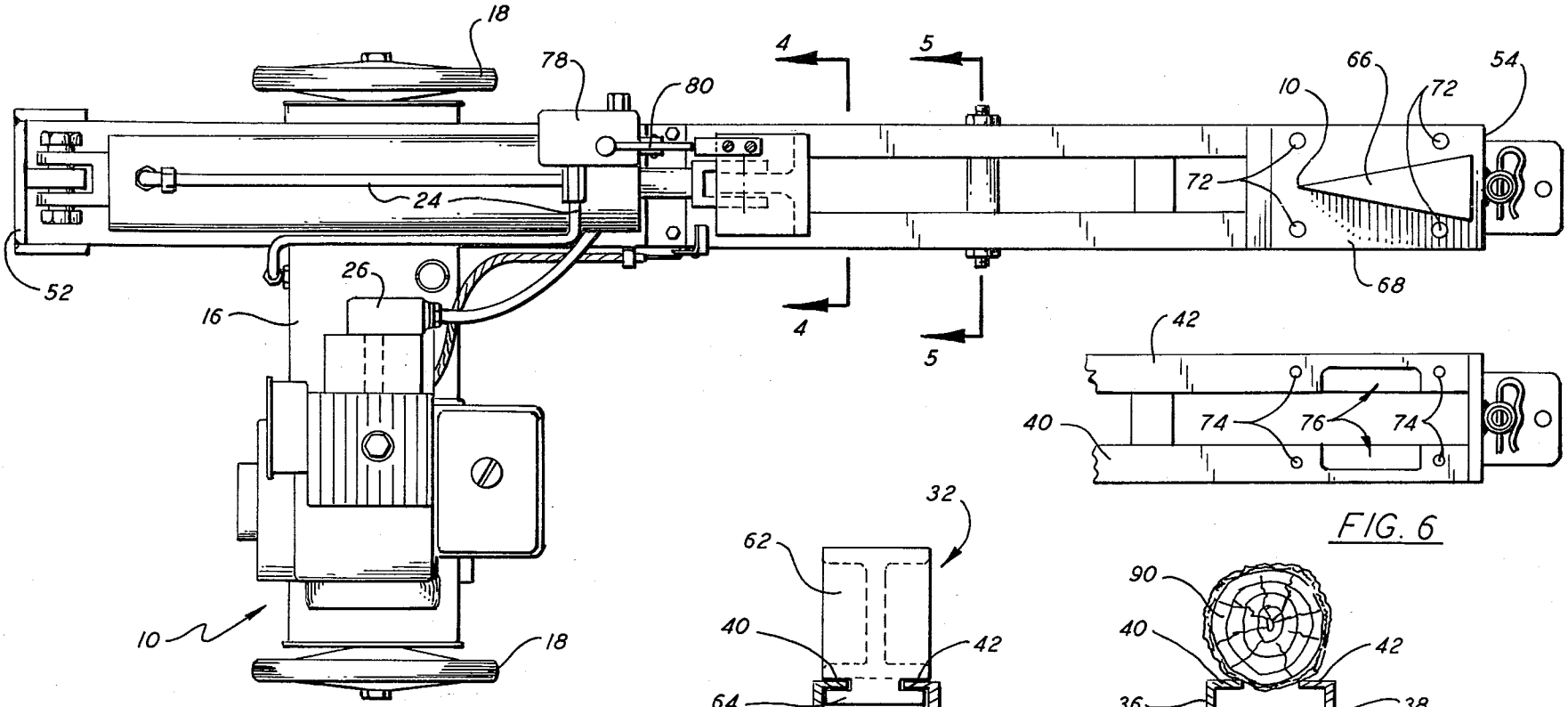
FIG. 3
FIG. 6
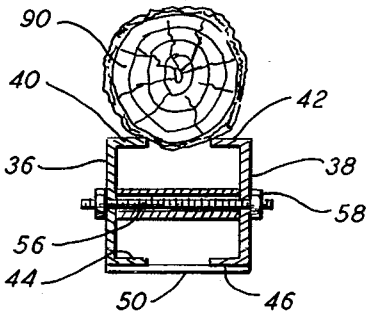
FIG. 5
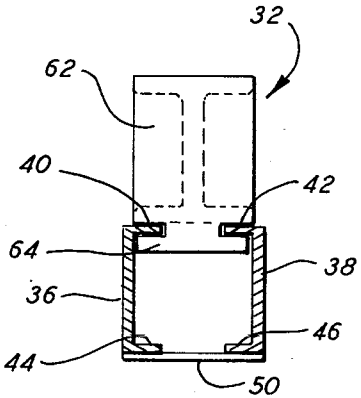
FIG. 4

POWER DRIVEN LOG SPLITTER

BACKGROUND OF THE INVENTION

The present invention relates to log splitting apparatus and, more specifically, to novel constructions of power driven log splitters.

Many forms of apparatus have been proposed for automating the task of splitting logs. Such apparatus includes portable, consumer-type machines wherein a hydraulic ram is used to force the logs endwise against a stationary splitting wedge. The wedge is commonly affixed at one end of an elongated frame along which the movable end of the ram travels. The log is supported upon the frame or auxiliary structure attached thereto as it is moved relative to the wedge.

It is a principal object of the present invention to provide log splitting apparatus having novel and improved means for supporting and guiding the log as it is moved relative to a stationary splitting wedge.

Another object is to provide a power driven log splitter having frame means of simple and economical construction which serve to support and guide both the logs and the movable end of the hydraulic ram without attachments or other auxiliary structure.

A further object is to provide power driven log splitting apparatus wherein parts most subject to wear may be easily removed and relaced.

A still further object is to provide a log splitter having a hydraulic cylinder with a pump powered by a gasoline engine and having automatic control of the throttle position and hydraulic valve.

In a more general sense, the object is to provide a novel, economical and rugged power driven log splitter.

Other objects will in part be obvious and will in part appear hereinafter.

SUMMARY OF THE INVENTION

In accordance with the foregoing objects, the invention comprises a log splitter having an elongated frame structure fixedly supporting a splitting wedge at one end and a hydraulic cylinder having a ram element reciprocally movable toward and away from the wedge. The frame is constructed of two U-shaped channel members rigidly connected with the free edges in opposed, spaced relation along the top and bottom of the frame. Thus, a log may be placed on the upper free edges of the two channel members with its lowermost surface depending into the space therebetween. The frame thereby serves both to support and to guide the log as it is pushed by the hydraulic ram longitudinally along the frame and is split by the wedge.

The portion of the ram which contacts the end of the log is formed with notches or grooves in each side for sliding engagement with the upper legs of the two channel members. That is, the opposing legs of the U-shaped channel members on the upper side extend into the notches, and thus constrain the path of movement of the log-engaging member. The wedge is affixed to a plate which is bolted to the upper side of each channel member. Cut-out areas in the upper legs of each channel member are normally covered by the wedge plate but, upon removal thereof, allow the log engaging member on the movable end of the ram to be withdrawn from its engagement with the frame structure for repair or replacement.

The hydraulic unit includes a pump for supplying fluid under pressure to the cylinder. A small gasoline engine is provided to power the pump. Automatic control of the throttle setting between idle and full speed positions is also provided, as is automatic control of the hydraulic valve which controls movement of the ram.

BRIEF CONTROL OF THE FIGURES

FIG. 3 is a top plan view;

FIGS. 4 & 5 are front elevational views in section on the lines 4—4 and 5—5 of FIG. 3, respectively; and FIG. 6 is a fragmentary, top plan view showing the front end of the apparatus with the wedge plate removed.

DETAILED DESCRIPTION

Figure 1:
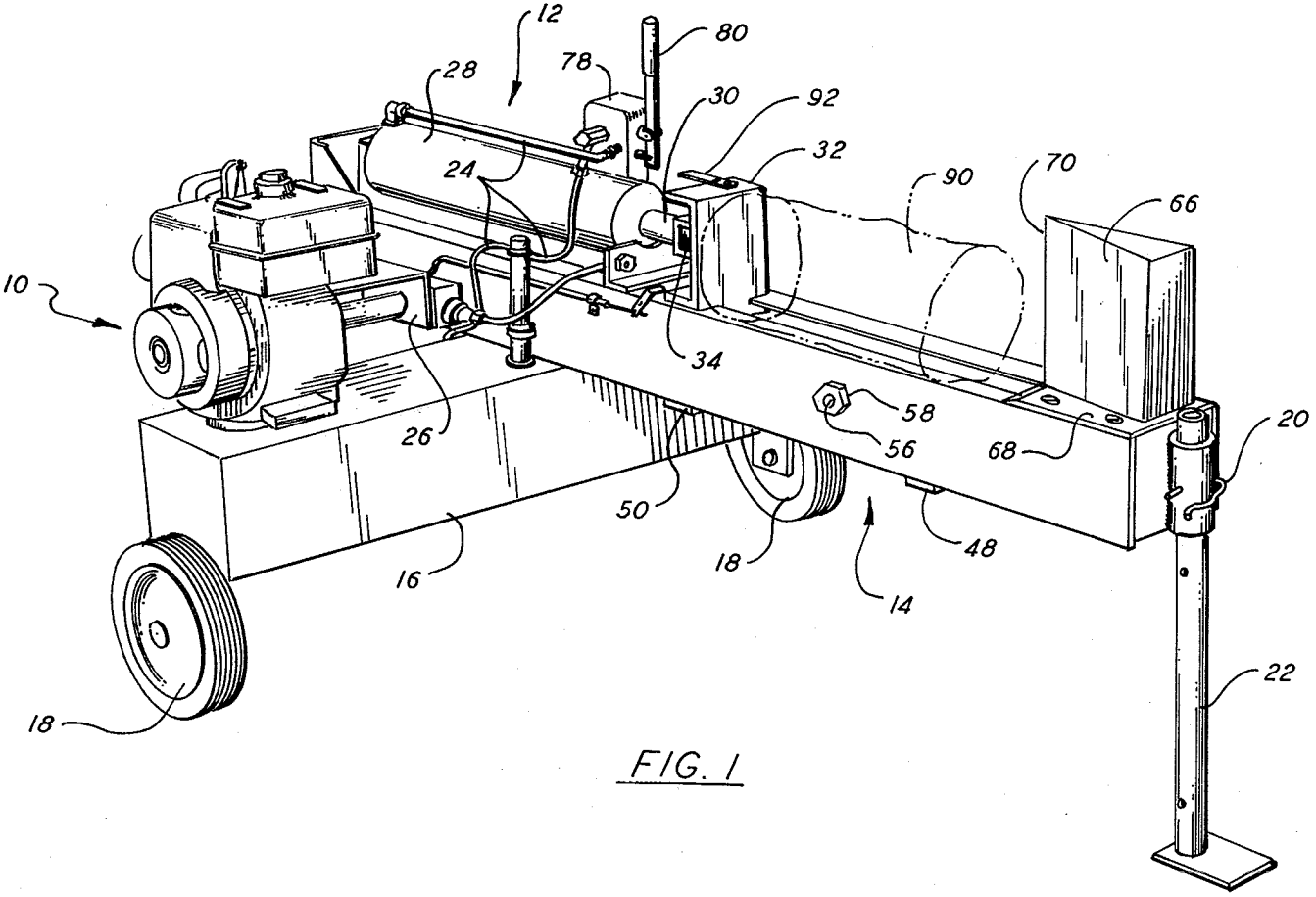
FIG. 1 is a perspective view of the log splitter of the present invention.
Figure 2:
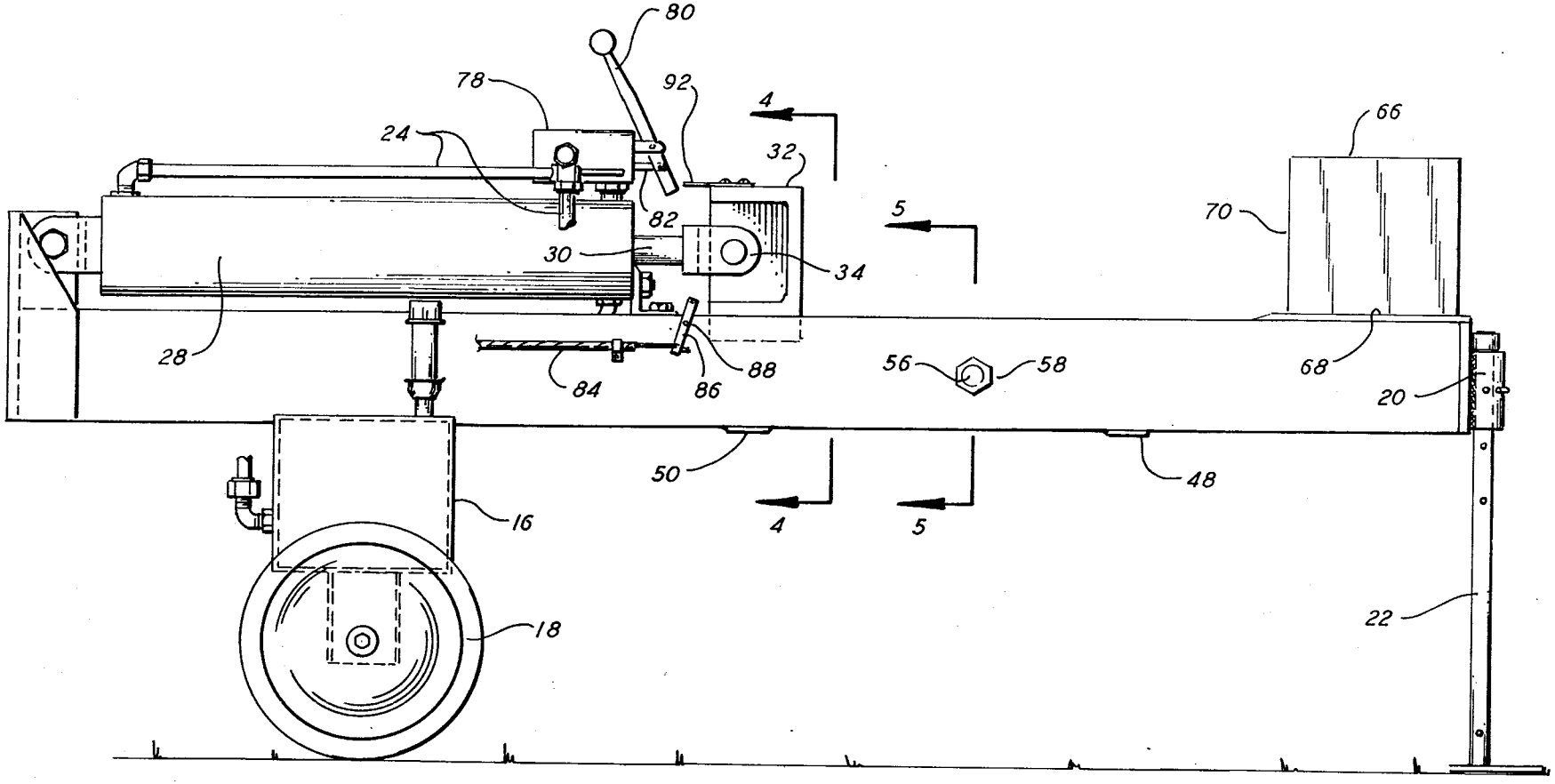
FIG. 2 is a side elevational view of the splitter of FIG. 1 with the motor and portions of the hydraulic system removed for clarity of showing of other elements.

Referring now to the drawings, the log splitter as shown in FIGS. 1-3, generally comprises gasoline engine 10, hydraulic system 12, and elongated frame structure 14. These elements may conveniently be supported upon the structure providing the oil reservoir 16 for hydraulic system 12. Reservoir 16 is supported upon the axles of wheels 18, providing transportability of the entire apparatus. Hitch means 20 on the forward end of the frame structure 14 provides means for attaching the apparatus to a vehicle for towing. The forward end is supported in the illustrated position by jack stand 22.

Engine 10 and hydraulic system 12 are of conventional design, having the usual throttle and valve controls, pump, etc. Lines 24 connect pump 26 with each of hydraulic cylinder 28 on opposite sides of a reciprocating piston from which rod 30 extends. Means other than the illustrated gasoline engine may, of course, be used to drive pump 26. For example, in some applications it may be desirable to provide a suitable mounting adapter to allow the pump to be driven from a tractor power take off. Ram element 32 is attached by clevis 34 to the free end of rod 30.

Referring now in more detail to the structure of frame means 14, a pair of separate, U-shaped, steel channel members of equal length are positioned with their medial portions 36 and 38 vertically disposed with the upper legs 40 and 42, and the lower legs 44 and 46, in parallel, facing relation and spaced apart by a predetermined distance. Bottom plates 48 and 50 are welded to lower legs 44 and 46 at intermediate positions along their length. End plates 52 and 54 are likewise welded to the opposite ends of each channel member. At a point approximately midway between bottom plates 48 and 50 openings are provided in medial portions 36 and 38 for bolt 56 which is secured on its threaded end by nut 58. Thus, the welded bottom and end plates, and bolt 56 insure rigidity and stability for frame means 12. Spacer 60 encircles bolt 56 to insure that the desired spacing is maintained between the channel members.

As best seen in FIG. 4, ram element 32 is assembled with frame 14 by means of grooves or notches in the ram element into which upper legs 40 and 42 of the channel members extend. The ram element may be considered as divided by the notches into upper portion 62, positioned above and resting upon upper legs 40 and 42, and lower portion 64, positioned below the upper legs. Lower portion 64 is wider than the spacing between the opposed legs of the channel members and slightly narrower than the inside spacing between medial portions 36 and 38. Thus, it may be seen that the illustrated construction and assembly provides both support and guidance for ram element 30 by frame means 14.

Splitting wedge 66 is welded to support plate 68 with cutting edge 70 vertically disposed and directed toward ram element 32. Support plate 68 is secured by bolts or screws 72 (FIG. 3) to the forward end of frame means 12. In FIG. 6 the forward end of frame means 12 is shown with plate 68 removed. Openings 74 are provided in legs 40 and 42 for screws 72 and cut-out areas 76 extend laterally to medial portions 36 and 38, having a length slightly greater than that of lower portion 64 of ram element 32. This provides easy removal of ram element 32 for replacement or repair simply by removing plate 68, removing the connection of the ram element to rod 30 and sliding the ram element to the forward end of the frame means 14, where the lower portion of the ram element may be removed through cut-out areas 76.

Movement of piston rod 30 and ram element 32 is controlled by hydraulic control valve 78, the position of which governs the flow of hydraulic fluid to opposite ends of cylinder 28. Handle 80 is connected through linkage 82 to the internal control member of valve 78. When the upper end of handle 80 is moved toward the forward end of the apparatus, i.e., toward wedge 66, hydraulic fluid is directed to the rearward end of cylinder 28 and ram element 32 is moved toward the wedge. When handle 80 is directed rearwardly, e.g., as shown in FIG. 2, rod 30 and ram element 32 are moved back toward cylinder 28. When handle 80 is in a substantially vertical position the valve is in a neutral position and fluid is not directed to either end of cylinder 28.

The throttle of engine 10 is connected through cable 84 to control member 86, pivotally attached at 88 (FIG. 2) to the side of frame means 12. The upper end of control member 86 extends over the top of the channel member to which it is attached, into the path of movement of ram element 32 at the rearmost portion of its movement. The throttle is spring biased toward the fully open position, which it assumes when member 86 is rotated with its upper end forward, as shown in FIG. 2. As ram element 32 approaches the end of its travel toward cylinder 28, it contacts the portion of member 86 which extends into its path, rotating member 86 in a counterclockwise direction as shown in FIG. 2, thereby moving the throttle to the idle position.

In operation, engine 10 is started with cylinder 28 in the retracted position and handle 80 vertical, i.e., valve 78 is in the neutral position. Log 90 is placed upon upper legs 40 and 42 of frame means 12, between ram element 32 and wedge 66. As seen in FIG. 5, the lowermost surface of the log will extend into the space between the opposing edges of legs 40 and 42, upon which the log is supported. With log 90 so positioned, the operator moves handle 80 forwardly, thereby directing hydraulic fluid to the rear end of cylinder 28 and moving ram element 32 forwardly to bring the end of log 90 into engagement with edge 70 of splitting wedge 66. Upon initial movement of ram element 32, member 86 is free to rotate under the spring bias on the throttle of engine 10. Thus, the throttle moves to the fully open position and pump 26 is driven to operate cylinder 28 at full load. Ram element 32 continues to move until cylinder 28 reaches the end of its stroke, at which point the ram element is a few inches from the wedge and the log has been split, the two pieces falling on opposite sides of the apparatus.

As a safety feature, handle 80 is spring biased from the forward back to the vertical position, wherein valve means 78 is in a neutral position. That is, the operator must continue to hold handle 80 in the forward position to continue movement of ram element 32 toward wedge 66. In case of any problems or emergencies, simply releasing handle 80, as would be the operator's natural reaction in such cases, serves to halt further movement of the ram.

When the splitting operation is completed, the operator moves handle 80 rearwardly. The handle preferably is not spring biased away from the rearward position, but may be left in this position so that the operator's hands are free to pick up another log as cylinder 28 returns to the retracted position.

Rod 30 and ram element 32 are then moved rearwardly until arm 92, attached to the upper side of ram element 32, contacts the lower end of handle 80, as shown in FIG. 2. Further rearward movement of ram element 32 from this position moves handle 80 to a vertical position, wherein further movement of the piston and rod 30 is stopped. Also, as ram element 32 reaches its rearmost position it contacts and rotates control member 88, thereby moving the throttle of engine 10 to the idle position. The elements remain stationary, with engine 10 idling, until another log has been positioned on the twin rail frame and handle 80 moved back to the forward position.

What is claimed is:

1. A power-operated log splitter comprising, in combination:

(a) a stationary splitting wedge having a vertically disposed cutting edge;

(b) frame means including a pair of U-shaped channel members fixedly positioned in spaced relation with the free edges of the two members being parallel and facing one another in substantially horizontal planes, whereby a log may be longitudinally supported upon the opposing free edges on the upper side of said two members;

(c) means fixedly securing said wedge to said frame means;

(d) a linearly reciprocating ram element having integrally formed upper and lower portions separated by notches extending into each side of said element along the entire length thereof;

(e) said channel members on the upper side of said two members extending into said notches to attach said ram element to said frame means for sliding movement along said channel members;

(f) the upper sides of each of said channel members including adjacent cut-out areas having a combined length and width at least as great as the length and width of said lower portion of said ram element, whereby said ram element may be disconnected from said rod and removed from attachment with said frame means by removal of said lower portion through said cut-out areas;

(g) drive means including a hydraulic cylinder having an operating rod and power means providing hydraulic power for reciprocating movement of said cylinder; and (h) means releasably connecting said ram element to the end of said operating rod.

2. The invention according to claim 1 wherein said means fixedly securing said wedge to said frame means include a plate secured to said upper sides of said channel members by threaded connecting means.

3. A power-operated log splitter comprising, in combination:

(a) a stationary splitting wedge having a vertically disposed cutting edge;

(b) frame means including a pair of U-shaped channel members fixedly positioned in spaced relation with the free edges of the two members being parallel and facing one another in substantially horizontal planes, whereby a log may be longitudinally supported upon the opposiing free edges on the upper side of said two members;

(c) a linearly reciprocating ram element having integrally formed upper and lower portions separated by notches extending into each side of said element along the entire length thereof;

(d) said channel members on the upper side of said two members extending into said notches to attach said ram element to said frame means for sliding movement along said channel members;

(e) drive means including a hydraulic cylinder having an operating rod and power means providing hydraulic power for reciprocating movement of said cylinder;

(f) means releasably connecting said ram element to the end of said operating rod;

(g) upper sides of each of said channel members include adjacent cut-out areas having a combined length and width at least as great as the length and width of said lower portion of said ram element, whereby said ram element may be disconnected from said rod and removed from attachment with said frame means by removal of said lower portion through said cut-out areas; and (h) means fixedly securing said wedge to said frame means including a plate secured to said upper sides of each of said channel members by threaded connecting means in covering relation to said cut-out areas, whereby said ram element may be removed from attachment with said frame means only upon removal of said plate.

4. The invention according to claim 3 and further including a valve element positionable to control the flow of hydraulic fluid to said cylinder, and a manually engageable handle connected to said valve element for positioning the same, said handle being spring biased for movement from the position wherein fluid to said cylinder causes movement of said ram element toward said wedge to the neutral position wherein said ram element is stationary.

5. The invention according to claim 4 wherein said handle and ram element include cooperative structure for movement of said handle from the position wherein fluid to said cylinder causes movement of said ram element away from said wedge to said neutral position in response to movement of said ram element to the fully retracted position.

6. The invention according to claim 5 wherein said power means comprises a gasoline engine and further including means for moving the throttle of said engine to an idle position in response to movement of said ram element to its fully retracted position, and for moving said throttle to a fully open position in response to movement of said ram element away from said fully retracted position.

* * * * *